United States Patent [19]

McCurdy

[11] 4,244,320

[45] Jan. 13, 1981

[54] WALLPAPER TROUGH ASSEMBLY

[76] Inventor: William McCurdy, R.R. 1, Palgrave, Ontario, Canada

[21] Appl. No.: 903,526

[22] Filed: May 8, 1978

Related U.S. Application Data

[63] Continuation of Ser. No. 760,276, Jan. 18, 1977, abandoned.

[30] Foreign Application Priority Data

Jan. 20, 1976 [CA] Canada ..... 243863

[51] Int. Cl.[3] ..... B05C 3/12

[52] U.S. Cl. ..... 118/419; 118/428; 118/429; 118/DIG. 17

[58] Field of Search ..... 118/DIG. 17, 428, 419, 118/429; 156/575; 134/92, 138; 242/55.53; 220/DIG. 12, DIG. 14; 206/408, 389, 443

[56] References Cited

U.S. PATENT DOCUMENTS

| | | | |
|---|---|---|---|
| D. 214,430 | 6/1969 | Kistler | D9/87 |
| 951,562 | 3/1910 | Hamelstrom | 118/DIG. 17 |
| 1,356,716 | 10/1920 | Hayes | 156/575 |
| 2,613,879 | 10/1952 | Carr, Jr. | 206/408 X |
| 3,304,034 | 2/1967 | Jones | 206/408 X |
| 3,575,771 | 4/1971 | Padgett | 156/575 X |
| 3,913,522 | 10/1975 | Light | 178/428 X |
| 3,995,763 | 12/1976 | Ayres et al. | 220/DIG. 14 |

*Primary Examiner*—John P. McIntosh
*Attorney, Agent, or Firm*—Murray & Whisenhunt

[57] ABSTRACT

This invention relates to an improved prepasted wallpaper trough assembly having a thin walled polystyrene tray with a horizontal bar. The bar is engaged in place in the tray by forcing the ends of the bar downward into channels formed in the ends of the tray. The width of the bar is slightly larger than the width of the channels and therefore the channels resiliently engage the ends of the bar. Thus, the "memory" factor of the plastic which, when deformed attempts to return to its original shape holds the bar in place during the wallpapering operation. The assembly is simple and its shape enables it to be made extremely economically by vacuum forming.

3 Claims, 3 Drawing Figures

WALLPAPER TROUGH ASSEMBLY

This is a continuation application of Ser. No. 760,276, filed Jan. 18, 1977, now abandoned.

BACKGROUND OF THE INVENTION

The present invention relates to an improved wallpaper trough assembly wherein a vacuum-formed plastic tray for wetting wallpaper has molded-in gripping channel to engage, under pressure two ends of a horizontal bar, channel, or tube which in turn holds prepasted paper under the water as it is drawn under the bar and through the water of the trough.

By using the natural flexibility and elasticity of thin walled plastic, considerable economy is gained in the overall cost of manufacturing plastic wallpaper troughs by eliminating the need for lenthy galvanized wire and the complex bending normally required for clipping.

Another object of the invention is to take advantage of the natural qualities of plastics. Although more costly than their corrugated cardboard counterparts, they will last longer and be useful as window box planters when the wallpaper job is completed or indeed may be used over and over as wallpaper troughs. Currently cardboard troughs are discarded after using. This is wasteful and a source of pollution.

Furthermore, plastic trays are purchased ready to use whereas their cardboard counterparts must be assembled.

In addition, plastic trays do not require packaging as small quantities may simply be bundled because of their superior resistance to weather and nestable design.

SUMMARY OF THE INVENTION

Accordingly, it is an object of the present invention to at least partially overcome these disadvantages by providing an improved wallpaper trough assembly which is economical to manufacture and easy to use.

To this end, in one of its aspects, the invention provides a wallpaper trough assembly comprising: (a) an upwardly open elongated vacuum molded plastic tray, said tray having first and second opposed ends; (b) an elongated rod having a uniform cross section extending horizontally in said tray between the first and second ends of said tray; and (c) an inwardly upwardly open channel formed in each end of said tray to receive a respective end of said rod, the width of the channel being sufficiently smaller than the width of the rod whereby the said end of said rod is resiliently engaged in said channel when the said end is forced down into said channel.

Further objects and advantages of the invention will appear from the following description taken together with the accompanying drawings.

DESCRIPTION OF THE PREFERRED EMBODIMENT

Figure 1:
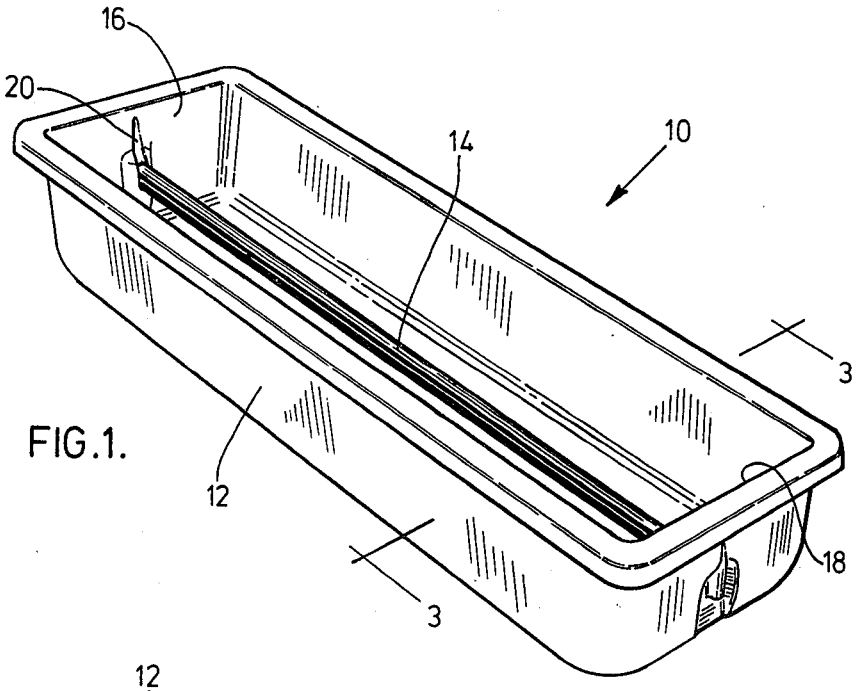
FIG. 1 is a perspective view of a wallpaper trough assembly according to a preferred embodiment of the invention.
Figure 2:
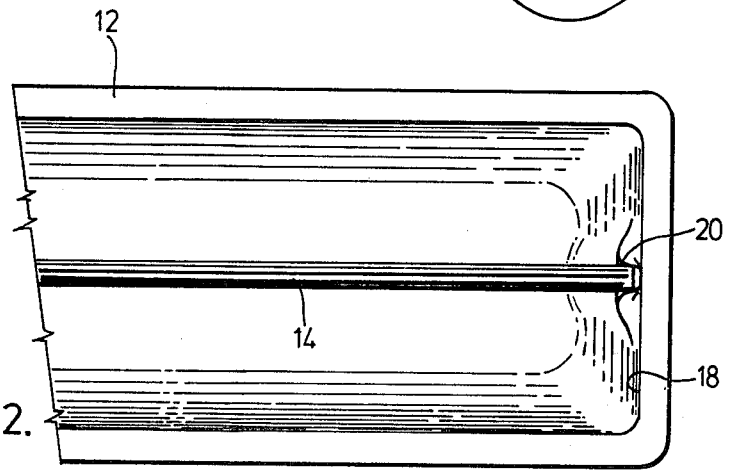
FIG. 2 is a partial plan view showing one end of the assembly seen in FIG. 1.
Figure 3:
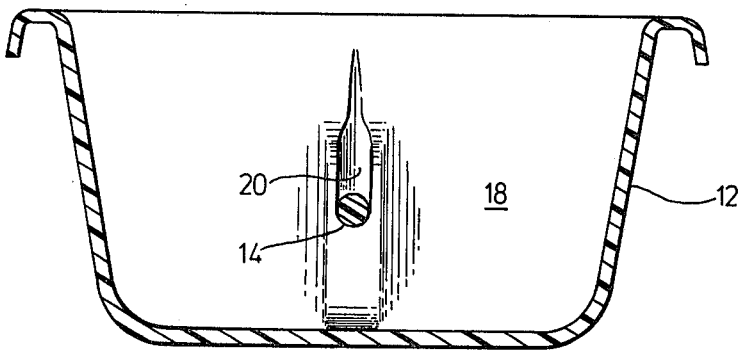
FIG. 3 is a sectional view taken along line III—III in FIG. 1.

Reference is first made to FIG. 1 which shows a wallpaper trough assembly 10 according to the invention having an elongated tray 12 and a rod 14. The tray 12 is thin walled and formed by vacuum molding of a suitable plastic such as polystyrene. The tray is of a suitable length to receive a width of wallpaper. The rod 14 extends horizontally along the length of the tray, and in this embodiment is hollow and has a uniform cross-section which is striated at its ends, as shown by 11 in FIG. 2.

The tray 12 has opposed ends 16,18 which (as clearly seen in FIG. 2) are molded to form inwardly upwardly open channels 20 which receive the respective ends of the rod 14. As mentioned above the tray 12 is formed of thin walled plastic and therefore the sides of the channels 20 are quite resilient. The channels are somewhat smaller in width than the ends of the rod 14.

In use, the tray 12 and rod 14 are normally purchased in the disassembled state. Each end of the rod 14 is forced downwardly into a respective one of the channels 20 until, in the assembled position, the ends of the rod 14 are resiliently engaged in the channels 20. Water is then poured into the tray and the prepasted wallpaper is passed under the rod 14 in a conventional manner.

It should be understood that the invention is not limited to this preferred embodiment. For instance, while the rod 14 in this embodiment is formed of plastic, it may also be formed of wood or steel and it is readily apparent that the rod 14 may have a variety of cross sectional shapes. Furthermore, the channels 20 or rod 14 may be striated to improve gripping of the rod.

What I claim is:

1. A wallpaper trough assembly consisting essentially of:

(a) an upwardly open rectangular vacuum molded plastic tray, said tray having a bottom, side walls, and first and second opposed ends, (b) an elongated bar having a uniform longitudinal cross-section extending horizontally in said tray between the first and second ends of said tray, and (c) an inwardly upwardly open channel integrally molded in each end of said tray near the bottom thereof to receive a respective end of said bar, the width of the channel being sufficiently smaller than the width of the bar and said channel being sufficiently flexible, so that the channel expands to accommodate the bar, whereby the said end of said bar is resiliently engaged in said channel when the said end is forced down into said channel and the bar is removably held near the bottom of the tray, and wherein the walls and sides of the trays are so configured that the trays are nestable and the rods are assemblable therein for use of the assembly.

2. An assembly as claimed in claim 1 wherein the bar has striated ends.

3. An assembly as claimed in claim 1 wherein the trough is formed of polystyrene.

* * * * *